US010365009B2

(12) United States Patent
Cong et al.

(10) Patent No.: US 10,365,009 B2
(45) Date of Patent: Jul. 30, 2019

(54) SYSTEMS AND METHODS TO DETECT HEATER MALFUNCTION AND PREVENT DRY BURNING

(71) Applicants: TRANE INTERNATIONAL INC., Davidson, NC (US); TRANE AIR CONDITIONING SYSTEMS (CHINA) CO., LTD., Jiangsu (CN)

(72) Inventors: Nipeng Cong, Jiangsu (CN); Hua Zhao, Shanghai (CN); Ping Yuan, Shanghai (CN)

(73) Assignees: TRANE INTERNATIONAL INC., Davidson, NC (US); TRANE AIR CONDITIONING SYSTEMS (CHINA) CO., LTD, Taicang, Jiangsu Province (CN)

( * ) Notice: Subject to any disclaimer, the term of this patent is extended or adjusted under 35 U.S.C. 154(b) by 0 days.

(21) Appl. No.: 15/507,566

(22) PCT Filed: Aug. 29, 2014

(86) PCT No.: PCT/CN2014/085509
§ 371 (c)(1),
(2) Date: Feb. 28, 2017

(87) PCT Pub. No.: WO2016/029428
PCT Pub. Date: Mar. 3, 2016

(65) Prior Publication Data

US 2017/0284698 A1 Oct. 5, 2017

(51) Int. Cl.
*H05B 1/02* (2006.01)
*F24F 13/22* (2006.01)
(Continued)

(52) U.S. Cl.
CPC ..... *F24F 13/22* (2013.01); *F24F 11/30* (2018.01); *H05B 1/028* (2013.01); *H05B 3/78* (2013.01);
(Continued)

(58) Field of Classification Search
CPC ..... F24F 13/22; F24F 13/221; F24F 2221/34; F25B 47/006; F25B 47/02; F25B 2347/02; F25B 2347/023; H05B 1/028
See application file for complete search history.

(56) References Cited

U.S. PATENT DOCUMENTS 2,529,215 A * 11/1950 Hicke ..... F25D 21/08 219/201
3,461,907 A * 8/1969 Wood, Jr. ..... F25B 41/00 137/386
(Continued)

FOREIGN PATENT DOCUMENTS

CN 2386568 Y 7/2000
CN 2402091 Y 10/2000
(Continued)

OTHER PUBLICATIONS

International Search Report and Written Opinion, International Patent Application No. PCT/CN2014/085509, dated May 29, 2015 (8 pages).
(Continued)

*Primary Examiner* — Jonathan Bradford
(74) *Attorney, Agent, or Firm* — Hamre, Schumann, Mueller & Larson, P.C.

(57) ABSTRACT

A heater, e.g. an anti-freezing heater, is disclosed. The heater can be configured to set off an alarm when a heating element is broken or malfunctioning. The heater can also be config-
(Continued)

ured to connect the heating element to a relatively low voltage when the heating element may experience a dry burning condition.

13 Claims, 4 Drawing Sheets

(51) Int. Cl.
*H05B 3/78* (2006.01)
*F24F 11/30* (2018.01)
*F24F 11/52* (2018.01)

(52) U.S. Cl.
CPC ..... *F24F 11/52* (2018.01); *F24F 2221/34* (2013.01); *H05B 2203/021* (2013.01)

(56) References Cited

U.S. PATENT DOCUMENTS 3,479,487 A * 11/1969 Stoll ..... G05B 19/075 219/494
3,918,268 A * 11/1975 Nussbaum ..... F25B 47/006 62/150
4,864,829 A * 9/1989 Manning ..... F25B 47/00 62/85
5,249,431 A * 10/1993 Kuribara ..... B60H 1/00978 374/148
5,297,393 A * 3/1994 Thompson ..... F25B 49/005 137/392
5,407,002 A * 4/1995 Voll ..... F24F 3/0442 165/11.1
5,813,242 A * 9/1998 Lawrence ..... F25B 41/062 62/156
5,839,294 A * 11/1998 Chiang ..... F25B 39/02 62/471
2005/0279112 A1* 12/2005 Wang ..... A23L 3/365 62/228.1
2007/0125764 A1 6/2007 Knoeppel et al.
2007/0199335 A1* 8/2007 Innes ..... F25B 30/02 62/151
2007/0289322 A1* 12/2007 Mathews ..... F24F 11/77 62/225
2011/0272391 A1 11/2011 Zhu et al.

FOREIGN PATENT DOCUMENTS

CN 1991272 A 7/2007
CN 102269313 A 12/2011
CN 102428749 A 4/2012
CN 102563985 A 7/2012
CN 203349590 U 12/2013
JP 2001128361 A 5/2001

OTHER PUBLICATIONS

Extended European Search Report; European Patent Application No. 14900367.5, dated May 30, 2018 (9 pages).

* cited by examiner

SYSTEMS AND METHODS TO DETECT HEATER MALFUNCTION AND PREVENT DRY BURNING

FIELD

The disclosure herein relates to a heater, such as for example, an anti-freezing heater in a heating, ventilation, and air conditioning (HVAC) system. More specifically, the disclosure herein relates to systems and methods to detect heater malfunction and/or prevent the heater from dry burning. The heater may work with a component of the HVAC system, such as for example, an evaporator, a water box, and/or a condenser, which may provide heat when the component is susceptible to and/or experiences a freezing condition.

BACKGROUND

A component of a HVAC system may experience a freezing condition during operation. For example, when an ambient temperature is relatively low (e.g. at or about 3° C.), water in an evaporator of the HVAC system may encounter a freezing condition. Other components, such as a condenser and a water box, of the HVAC system may also experience a freezing condition during operation. The term "freezing condition" generally refers to a condition when liquid (e.g. water or refrigerant) inside a component and/or on an outer surface of the component may freeze. A heater (e.g. an anti-freezing heater) may be used to provide heat when the component of the HVAC system may experience a freezing condition.

SUMMARY

A heater, for example, an anti-freezing heater in a HVAC system, is disclosed. In some embodiments, the heater may include a heating element; a power supply including a high voltage power and a low voltage power; and a voltage selector configured to select the high voltage power or the low voltage power to the heating element. In some embodiments, the voltage selector may be configured to select the high voltage power or the low voltage power based on a temperature on the heating element.

In some embodiments, the heater may include a thermostat positioned on a location of the heating element. In some embodiments, the heater may further include a monitoring alarm and a relay; and the power supply, the relay, the monitoring alarm, the heating element, and the voltage selector may be connected in series, forming a power circuit.

In some embodiments, the monitoring alarm may be configured to set off an alarm when the power circuit is open.

Other features and aspects of the systems, methods, and control concepts will become apparent by consideration of the following detailed description and accompanying drawings.

BRIEF DESCRIPTION OF THE DRAWINGS

Reference is now made to the drawings in which like reference numbers represent corresponding parts throughout.

FIG. 3A illustrates that a heating element of the heater is connected to a relatively high voltage power. FIG. 3B illustrates that a heating element of the heater is connected to a relatively low voltage power.

FIG. 4A illustrates a schematic diagram of a heating element. FIG. 4B illustrates a temperature/time diagram and an amp/time diagram.

DETAILED DESCRIPTION

Components of a HVAC system, e.g. an evaporator, a condenser, and/or a water box, may experience a freezing condition during operation, e.g. when the unit is off under a relatively low ambient temperature. A heater (e.g. an anti-freezing heater) may be used to prevent and/or recover the components from the freezing condition.

References are made to the accompanying drawings that form a part hereof, and in which is shown by way of illustration of the embodiments in which the embodiments may be practiced. It is to be understood that the term used herein are for the purpose of describing the figures and embodiments and should not be regarded as limiting the scope.

Figure 1:
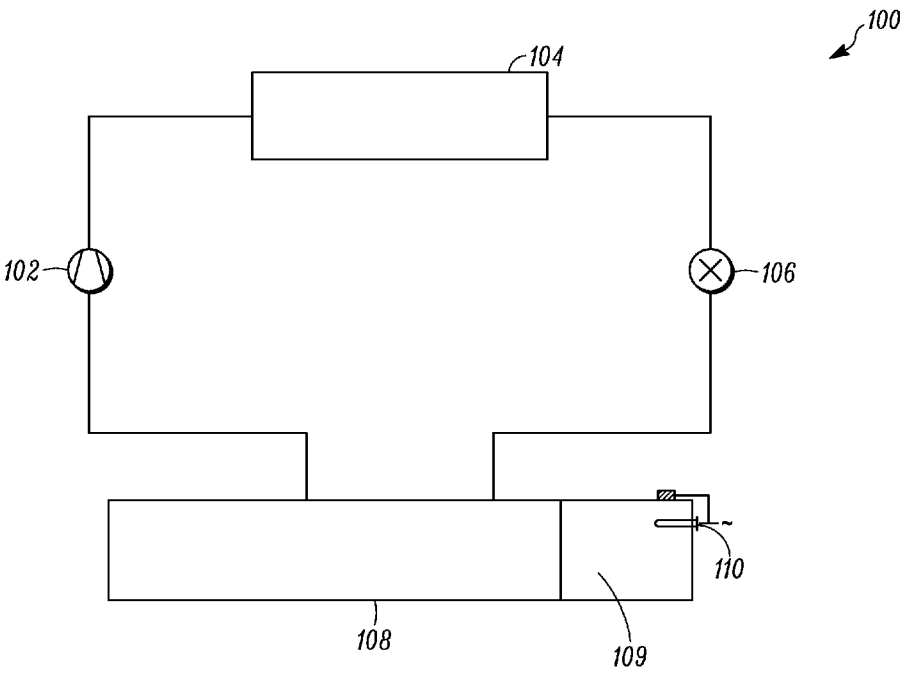
FIG. 1 illustrates a schematic diagram of a HVAC refrigeration system.

FIG. 1 illustrates that a HVAC system 100 that includes a compressor 102, a condenser 104, an expansion device 106 and an evaporator 108 forming a refrigeration circuit. The evaporator 108 may include a water box 109 configured to provide a working fluid (e.g. water) to the evaporator 108.

When the ambient temperature is relatively low (e.g. at or about 3° C.), the working fluid in the water box 109 may freeze. As illustrated, the water box 109 may be equipped with a heater 110 to help prevent a freezing condition, and/or recover from a freezing condition.

Figure 2:
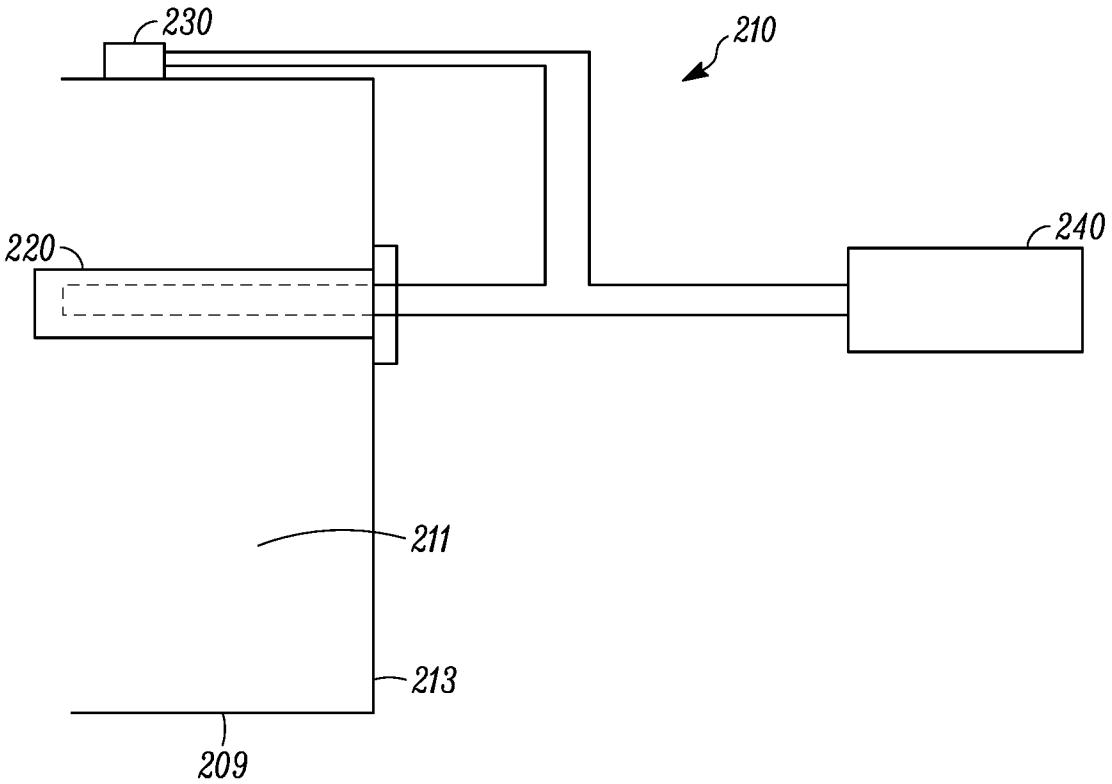
FIG. 2 (PRIOR ART)
FIG. 2 illustrates a traditional heater design.

FIG. 2 illustrates a traditional heater configuration. The heater 210 includes a heating element 220 and a controller 230. The heating element 220 can be positioned in a space 211 of a component 209 (e.g. a water box). The heater 210 can be powered by a power source 240. The controlled switch 230 can control whether the power source 240 is provided to the heating element 220. Generally, when the power source 240 is provided, the heating element 220 can provide heat, and when the power source 240 is not provided, the heating element 220 does not provide heat.

In the traditional heater configuration, the controlled switch 230 can be a thermostat positioned on a housing 213 of the component 209, with the understanding that the thermostat can also be positioned at other locations (e.g. inside the shell 213). When a temperature of the housing 213 is below a temperature threshold (e.g. 3° C.), for example, the controlled switch 230 can connect the power source 240 to the heating element 220. When the temperature of the housing 213 is above the temperature threshold, for example, the controlled switch 230 can disconnect the power source 240 from the heating element 220.

The heater 210 may experience a "dry burning" condition. The term "dry burning condition" refers to a situation that the heating element 220 is connected to the power source 240 to provide heat while there is no or very little liquid (e.g. water) in the space 211. The heating element 220 can be damaged relatively easily in the dry burning condition because of, for example, overheating of the heating element 220. The dry burning condition can happen, for example, when a user of the HVAC system empties the component 209.

Figure 3A:
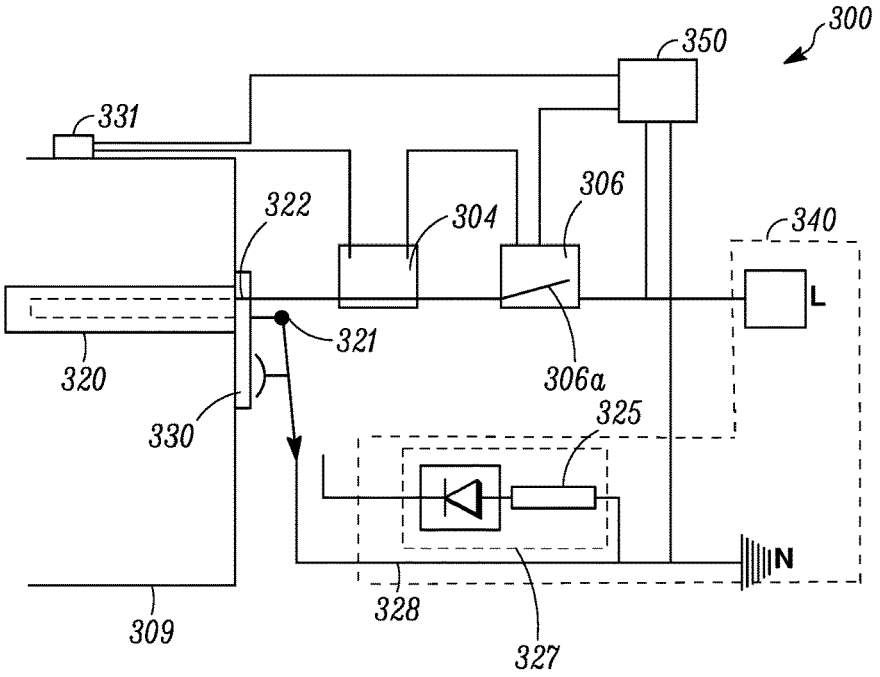
FIGS. 3A and 3B illustrate a heater according to one embodiment of this disclosure.
Figure 3B:
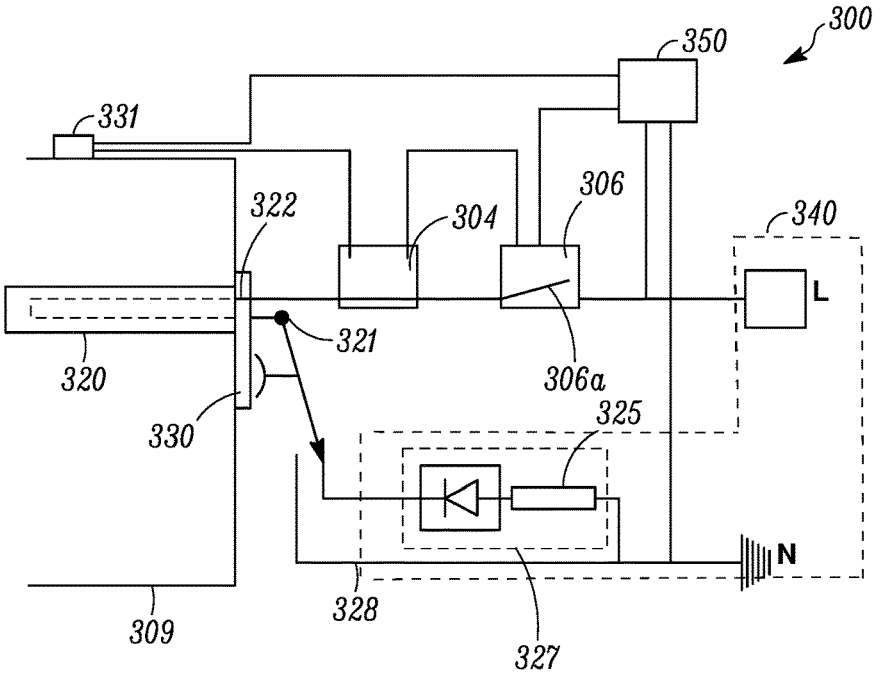

FIGS. 3A and 3B illustrate a heater 300 according to one embodiment of this disclosure. The heater 300 can be configured to set off an alarm (e.g. a monitoring alarm 304) when a circuit including a heating element 320 is open (e.g. a component of the circuit is broken or malfunction). The heater 300 can also be configured to connect the heating element 320 to a relatively low voltage power (e.g. FIG. 3B) when the heating element 320, for example, may experience a dry burning condition.

The heater 300 includes the heating element 320, which may be positioned inside a component 309 (e.g. a water box) to provide heat. The heating element 320 includes a first terminal 321 and a second terminal 322. A voltage selector 330 can be configured to selectively connect the first terminal 321 to a power source 340 that includes a relatively high voltage power and a relatively low voltage power. Referring to FIG. 3A, the first terminal 321 is connected to a high voltage circuit 328 (e.g. connected to the ground directly). As a result, the heating element 320 is provided with the relatively high voltage power. Referring to FIG. 3B, the first terminal 321 is selected to the low voltage circuit 327 that includes a resistor divider 325. As a result, the heating element 320 is provided with the relatively low voltage power.

The second terminal 322 of the heating element 320 is connected to the monitoring alarm 304, a relay 306, and the power source 340 in series. The relay 306 includes a relay switch 306*a*. The relay switch 306*a* have an "on" state and an "off" state. When the relay switch 306*a* is in the "off" state, the heating element 320 is disconnected from the power source 340. When the relay switch 306*a* are in the "on" state, the heating element is connected to the power source 340.

In some embodiments, the heater 300 also includes a power switch 350 and a controller 331. The controller 331 in some embodiments may be configured to control, for example, a state of the power switch 350. The power switch 350 is configured to control the state of the relay 306. In some embodiments, the controller 331 can be positioned on the component 309, and control the state of the power switch 350 and/or the alarm switch 304 based on, for example, a temperature on an outer surface of the component 309. In some embodiments, the controller 331 can be a thermostat (e.g. a bimetal thermostat, a capillary thermostat, a pressure-type thermostat, or the like). In some embodiments, the controller 331 can be an electric temperature controller or a digital temperature controller.

In operation, when the component 309 is at a relatively high temperature (e.g. higher than 3° C.), the component 309 is generally not susceptible to a freezing condition. In such a condition, the controller 331 may be configured to set the power switch 350 to an "off" state. The "off" state of the power switch 350 can trigger the relay switch 306*a* to the "off" state. The heating element is thus disconnected from the power source 340.

When, for example, the component 309 is at a relatively low temperature (e.g. at or about 3° C.), the component 309 may be susceptible to a freezing condition. In such a condition, the controller 331 may be configured to set the power switch 350 to an "on" state. The "on" state of the power switch 350 can trigger the relay switch 306*a* to the "on" state. The heating element 320 can be connected to the power source 340, and the heating element 320 can provide heat.

A power circuit, which is configured to provide power to the heating element 320 to provide heat may include the power source 340, the relay 306, the monitoring alarm 304, the heating element 320. The voltage selector 330 can be connected to either the low voltage circuit 327 or the high voltage circuit 328 of the power source 340. When, for example, the power circuit is in normal operation, e.g. the heating element 320 is connected to the power source 340 and provides heat, the monitoring alarm 304 will not set off an alarm. When, for example, the power circuit is open, e.g. if a component (e.g. the heating element 320) of the power circuit is broken or malfunctioning, the monitoring alarm 304 will provide alarm to notify a customer. In some embodiments, the alarm can include an audible alarm and/or light alarm.

In some embodiments, the alarm can include an alarm signal that can be transmitted to a remotely located device through a wire or wirelessly. In some embodiments, the alarm can include a combination of more than one type of alarm.

The voltage selector 330 is configured to monitor a temperature of the heating element 320. When the temperature of the heating element 320 is below a threshold, the voltage selector 330 is configured to connect the heating element 320 to the high voltage circuit 328 (e.g. connect to the relatively high voltage power), so that the heating element 320 can provide heat normally. When the temperature of the heating element 320 reaches or exceeds the threshold, which may indicate that the heating element 320 may experience a dry burning situation, the voltage selector 330 is configured to connect the heating element 320 to the low voltage circuit 327 (e.g. connect to the relatively low voltage power) to protect the heating element 320 from overheating. When the heating element 320 is connected to the low voltage circuit 327, the heat provided by the heating element 320 can be reduced, resulting a lower operation temperature for the heating element 320. In some embodiments, the low voltage circuit 327 can be configured to provide a voltage to the heating element 320 that can help keep the heating element 320 below a safe operation temperature. In some embodiments, the low voltage circuit 327 can be configured to provide a voltage that can keep the monitoring alarm 304 off. In some embodiments, the low voltage circuit 327 can be configured to keep the temperature of the heating element 320 below a safe operation condition, but higher than a threshold of the voltage selector 330, so that the voltage selector 330 does not frequently cycle between the relatively high voltage circuit 328 and the relatively low voltage circuit 327.

When the heating element is connected to the relatively low voltage (e.g. is connected to the low voltage circuit 327), a voltage can still be provided to the monitoring alarm 304 so that the monitoring alarm 304 will not set off an alarm.

Figure 4A:
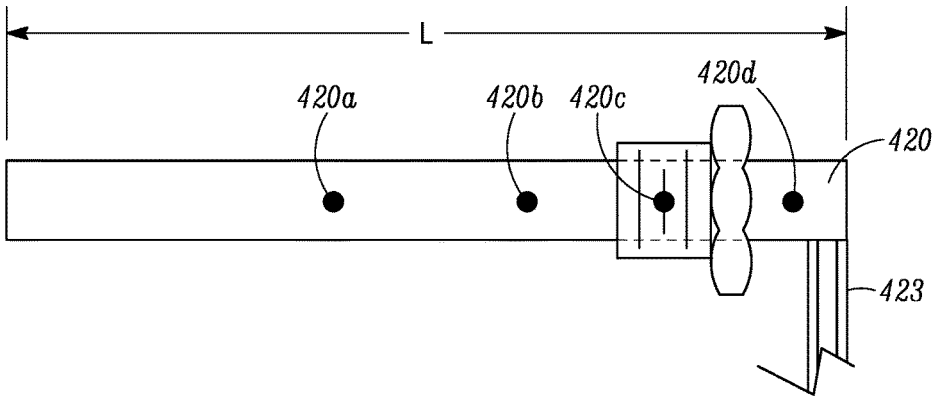
FIGS. 4A and 4B illustrate how a threshold for selecting a relatively high voltage or a relatively low voltage is determined.
Figure 4B:
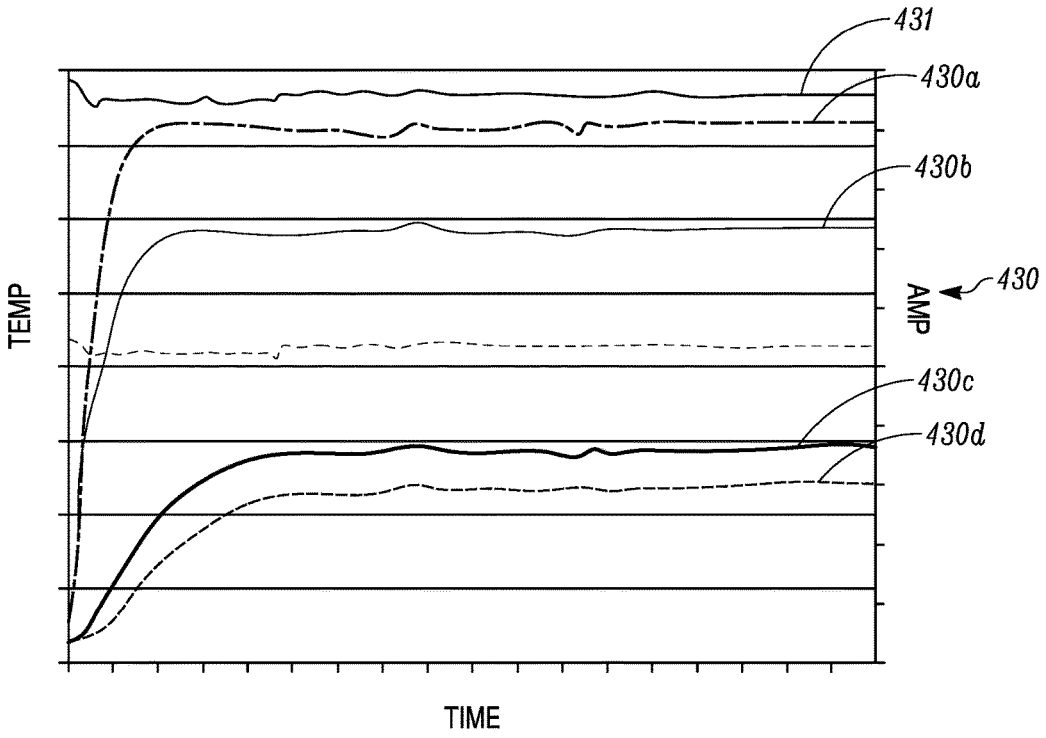

FIGS. 4A and 4B illustrate a method of determining a threshold for switching between a relatively high voltage (e.g. 220 v AC) and a relatively low voltage (e.g. 60 v AC) with respect to a heating element 420 (e.g. corresponding to the heating element 320 in FIGS. 3A and 3B).

FIG. 4A illustrates a schematic diagram of the heating element 420, which has a length L. To determine the threshold, a temperature reading can be taken at one or more locations (e.g. 420*a*, 420*b*, 420*c*, and 420*d*) along the length L in a dry burning testing. The temperature reading locations can be, for example, relatively close to where wire(s) (e.g. wires 423) are connected to the heating element 420 (e.g. 420*d*), relatively close to a center (e.g. 420*a*) of the heating element 420, on a mount (e.g. 420*c*) of the heating element 420, or other suitable locations (e.g. 420*b*, 420*d*).

FIG. 4B illustrates temperature readings over time at each of the locations after a current (as illustrated by current curve 431) is provided to the heating element 420. Curve 430*a* corresponds to location 420*a*, curve 430*b* corresponds to location 420*b*, curve 430*c* corresponds to location 420*c*, and curve 430*d* corresponds to location 420*d*.

A threshold can be chosen based on the curves in FIG. 4B. Based on the curves as shown in FIG. 4B, a temperature at one location (e.g. the location 420*d*) can be corresponded to a temperature at another location (e.g. the location 420*a*). For example, a temperature reading on the curve 430*d* can be correspond to a specific time point. And the specific time point can be used to correspond the temperature reading on the curve 430*d* to a temperature reading on other curves 430*a*, 430*b* and/or 430*c*. Thus, a threshold can be set at a location that may be convenient for temperature measurement, while the threshold can be corresponded to a desired temperature (e.g. a safe operation temperature) at another location.

In one embodiment, a voltage selector (e.g. the voltage selector 330 in FIG. 3) may be configured to switch based on a threshold at the location 420*d*, where the wires 423 are connected to the heating element 420. The threshold (e.g. at or about 212° C.) can be at or below a temperature that the wires 423 can tolerate (e.g. at or about 250° C. for a Teflon covered wire). When the threshold is reached or exceeded, the voltage selector can switch the power supply from a relatively high voltage to a relatively low voltage.

In another embodiment, the voltage selector may be configured to switch based on a threshold at location 420*d*. The threshold at location 420*d* may be corresponded to a safe operation temperature of the heating element 420, e.g. a safe operation temperature at the locations 420*a* or 420*b*. When the threshold at location 420*d* is reached, indicating the temperature of the heating element may exceed the safe operation temperature, the voltage selector can switch the power supply from a relatively high voltage to a relatively low voltage.

It is to be noted that the embodiments as disclosed herein may be applicable to a situation where a heater may experience a dry-burning situation.

Aspects

Any of aspects 1-6 can be combined with any of aspects 7-14. Any of aspects 7-12 can be combined with any of aspects 13 and 14.

Aspect 1. A heater comprising:

a heating element;

a power supply including a high voltage power and a low voltage power; and a voltage selector configured to select the high voltage power or the low voltage power to the heating element;

wherein the voltage selector is configured to select the high voltage power or the low voltage power based on a temperature on the heating element.

Aspect 2. The heater of aspect 1, wherein the voltage selector includes a thermostat positioned on the heating element.

Aspect 3. The heater of aspects 1-2, further comprising:

a monitoring alarm; and a relay;

wherein the power supply, the relay, the monitoring alarm, the heating element, and the voltage selector are connected in series, forming a power circuit.

Aspect 4. The heater of aspect 3, wherein the monitoring alarm is configured to set off an alarm when the power circuit is open.

Aspect 5. The heater of aspects 1-4, wherein the heating element is positioned on a component of a HVAC system.

Aspect 6. The heater of aspects 1-5, where in the heating element is positioned on a waterbox of a HVAC system.

Aspect 7. A HVAC system, comprising:

an evaporator;

a heater configured to provide heat to the evaporator; wherein the heater includes:

a heating element;

a power supply including a high voltage power and a low voltage power; and a voltage selector configured to select the high voltage power or the low voltage power to the heating element;

wherein the voltage selector is configured to select the high voltage power or the low voltage power based on a temperature on the heating element.

Aspect 8. The HVAC system of aspect 7, wherein the voltage selector includes a thermostat positioned on the heating element.

Aspect 9. The HVAC system of aspects 7-8, wherein the heater further comprising:

a monitoring alarm; and a relay;

wherein the relay, the monitoring alarm, the heating element, the voltage selector, and the power supply are connected in series, forming a circuit.

Aspect 10. The HVAC system of aspect 9, wherein the monitoring alarm is configured to set off an alarm when the circuit is open.

Aspect 11. The HVAC system of aspects 7-10, wherein the heating element is positioned on the evaporator.

Aspect 12. The HVAC system of aspects 7-11, where in the heating element is positioned on a waterbox of the evaporator.

Aspect 13. A method of providing heat to a component in a HVAC system, comprising:

measuring a temperature of a heating element in the HVAC system;

when the temperature of the heating element exceeds a threshold, connecting the heating element to a high voltage power; and when the temperature of the heating element is below a threshold, connecting the heating element to a low voltage power.

Aspect 14. The method of aspect 13, further comprising:

when the heating element experiences malfunction, setting off an alarm.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What is claimed is:

1. An HVAC system, comprising:

an evaporator; and a heater configured to provide heat to the evaporator, wherein the heater includes a circuit, the circuit is configured to prevent a dry burning condition, the circuit includes:

a heating element disposed inside a component of the evaporator;

a power supply including a high voltage power and a low voltage power; and a voltage selector configured to select the high voltage power or the low voltage power to the heating element, wherein the voltage selector is configured to select the high voltage power or the low voltage power based on a temperature of the heating element, wherein when the temperature of the heating element exceeds a first predetermined threshold, the voltage selector selects the low voltage power, wherein when the temperature of the heating element is below a second predetermined threshold, the voltage selector selects the high voltage power, and wherein the first predetermined threshold is greater than the second predetermined threshold.

2. The HVAC system of claim 1, wherein the voltage selector includes a thermostat positioned on the heating element.

3. The HVAC system of claim 1, wherein the heater further comprises:

a monitoring alarm; and a relay;

wherein the relay, the monitoring alarm, the heating element, the voltage selector, and the power supply are connected in series.

4. The HVAC system of claim 3, wherein the monitoring alarm is configured to set off an alarm when the circuit is open.

5. A method of providing heat to a component in an HVAC system, comprising:

measuring a temperature of the heating element in the HVAC system of claim 1;

when the temperature of the heating element exceeds a threshold, connecting the heating element to the high voltage power; and when the temperature of the heating element is below the threshold, connecting the heating element to the low voltage power.

6. The method of claim 5, further comprising:

when the heating element experiences malfunction, setting off an alarm.

7. The HVAC system of claim 1, wherein when the high voltage power is selected to the heating element, a terminal of the heating element is directly connected to a ground.

8. The HVAC system of claim 1, wherein when the low voltage power is selected to the heating element, a terminal of the heating element is connected to the circuit that includes a resistor divider.

9. The HVAC system of claim 1, wherein the temperature of the heating element is read from a location on the heating element.

10. The HVAC system of claim 1, wherein the component is a water box.

11. The HVAC system of claim 1, further comprising:

a controller; and a power switch, wherein when the component is not susceptible to a freezing condition, the controller is configured to set the power switch to a first state to disconnect the heating element from the power supply, and wherein when the component is susceptible to a freezing condition, the controller is configured to set the power switch to a second state to connect the heating element to the power supply.

12. The HVAC system of claim 1, further comprising:

a monitoring alarm, wherein when the heating element provides heat, the monitoring alarm does not set off an alarm, and wherein when the heating element experiences malfunction, the monitoring alarm sets off the alarm.

13. The HVAC system of claim 1, wherein when the voltage selector selects the low voltage power, the heater is configured to keep the temperature of the heating element below the first predetermined threshold but above the second predetermined threshold.

* * * * *